US007699044B2

(12) United States Patent
Lepley

(10) Patent No.: US 7,699,044 B2
(45) Date of Patent: Apr. 20, 2010

(54) SILICON-CONTROLLED RECTIFIER SHUT-OFF CIRCUIT FOR CAPACITIVE DISCHARGE IGNITION SYSTEM

(75) Inventor: Joseph M. Lepley, Girard, OH (US)

(73) Assignee: Altronic, LLC, Girard, OH (US)

( * ) Notice: Subject to any disclaimer, the term of this patent is extended or adjusted under 35 U.S.C. 154(b) by 36 days.

(21) Appl. No.: 12/185,851

(22) Filed: Aug. 5, 2008

(65) Prior Publication Data

US 2010/0031942 A1 Feb. 11, 2010

(51) Int. Cl.
*F02P 3/06* (2006.01)
*F02P 3/08* (2006.01)

(52) U.S. Cl. ..... 123/596

(58) Field of Classification Search ..... 123/596, 123/594, 605, 618, 644, 648, 655, 656; 315/209 R, 315/209 CD, 209 SC
See application file for complete search history.

(56) References Cited

U.S. PATENT DOCUMENTS 3,583,378 A 6/1971 Pattee
3,800,771 A 4/1974 Mackie
3,838,328 A 9/1974 Lundy
4,069,801 A 1/1978 Stevens
4,413,608 A * 11/1983 Beeghly ..... 123/406.66
4,522,184 A 6/1985 Lepley

* cited by examiner

*Primary Examiner*—Mahmoud Gimie
(74) *Attorney, Agent, or Firm*—The Webb Law Firm

(57) ABSTRACT

A capacitive discharge ignition system for an internal combustion engine and for use with a generator powered current source comprises a storage capacitor, at least one power thyristor for discharging the storage capacitor to transfer energy to at least one coil triggered in synchronism with an internal combustion engine with which the ignition system may be associated. A triggering circuit biases the power thyristor to discharge the storage capacitor. A shut-off circuit comprises a solid state device for switching the output of the generator to ground interrupting the flow of current to the power thyristor. A circuit sensing current flow in the triggering circuit generates a control and gates the solid state device into conduction in response to the control signal.

10 Claims, 1 Drawing Sheet

SILICON-CONTROLLED RECTIFIER SHUT-OFF CIRCUIT FOR CAPACITIVE DISCHARGE IGNITION SYSTEM

BACKGROUND OF THE INVENTION

1. Field of the Invention

This invention relates to capacitive discharge ignition systems in which a storage capacitor is charged by a generator or alternator and is discharged by a silicon-controlled rectifier (SCR) or thyristor switch triggered conducting in synchronism with the engine.

2. Description of Related Art

The Problem of turning SCRs off in capacitive discharge ignition systems is well known. Once triggered to conduct, the SCR remains conducting until the current source stops and the triggering pulse is removed. A number of patents have addressed shutting down the anode-to-cathode current from the source charging the storage capacitor. These have all related to direct current to direct current converter power supplies which can be electronically shut-down. See, for example, U.S. Pat. Nos. 3,583,378; 3,800,771; 3,838,328; and 4,069,801. The output of an alternator or generator cannot be switched off as with direct current converter power supplies. The output being an alternating current will periodically pass through zero. At this time, the SCR will shut down. However, it is desired to shut down the SCR immediately, that is, without waiting for the next polarity reversal of the alternator or generator. The applicant's circuit is directed to the shutting off of the power SCR in a capacitive discharge ignition system supplied by a generator or alternator.

U.S. Pat. No. 4,522,184 specifically addresses these shortcomings, but does so at the cost of added circuit complexity. The present invention reduces power loss and provides simplified circuitry.

SUMMARY OF THE INVENTION

This invention is an improvement in circuits for capacitive discharge ignition systems for internal combustion engines which ignition systems are charged by a generator or alternator. Capacitive discharge ignition systems comprise a storage capacitor charged through a diode or full wave rectifier. At least one main silicon-controlled rectifier (SCR) or other suitable thyristor is provided for discharging the storage capacitor through the primary of an ignition coil. A triggering circuit provides a gate pulse to the main SCR gate in synchronism with the internal combustion engine. A shut-off circuit includes a solid state device for grounding the output of the generator or a full wave rectifier connected to the output of the generator during the discharge of the storage capacitor.

The triggering circuit comprises a second SCR that is triggered by a pick-up pulse generated, for example, by the rotation of the engine crank shaft. The second SCR then discharges a triggering capacitor to the gate of the main SCR. The storage capacitor is discharged in response to the firing of the triggering circuit.

The LED of an optocoupler is placed in series with the triggering circuit. The phototransistor of the optocoupler is placed in series with the shut-off circuit. When the phototransistor conducts, the shut-off circuit charges a holding capacitor at the gate of a switch, preferably an FET switch. Preferably, a zener diode limits the voltage on the capacitor to less than the breakover voltage of the FET gate. A discharge resistor is placed across the holding capacitor.

After the SCR is triggered by the triggering circuit, the main storage capacitor starts to discharge. At this time, the triggering current shunted through the optocoupler gates the phototransistor into conduction. Almost immediately, the holding capacitor at the FET gate is charged from the storage capacitor to the fully conductive level of the FET gate and the FET shorts the output of the full wave rectifier to ground. As the storage capacitor discharges, its charge falls below the charge on the holding capacitor before the storage capacitor is fully discharged. However, the holding capacitor keeps the voltage at the FET gate above the threshold voltage until after the storage capacitor has completely discharged and, therefore, the SCR has turned off.

Previous techniques required the sensing of the discharge current directly which wasted considerable power (~100 watts, 50 amp×2 volts) since the required sensing circuitry added significant impedance to the discharge loop. By sensing only the triggering current to the power device rather than the primary discharge, the wasted power is reduced to approximately 0.1 watt (0.1 amps×1 volt).

In previous techniques, grounding the output of the generator was the only function of the FET. Preferably, in this invention, the FET functions as a linear voltage regulator biased through a series of very low power zener diodes. This approach eliminates the need for a costly and failure prone high power zener diode across the storage capacitor. As the storage capacitor charges to the desired maximum voltage, the gate of the FET will be biased to turn conducting causing it to conduct current and thereby limiting the voltage of the storage capacitor. The double duty out of the shorting FET reduces the cost and complexity of the circuitry needed for proper operation of the system.

BRIEF DESCRIPTION OF THE DRAWING

Further features and other objects and advantages of this invention will become clear from the following detailed description made with reference to the drawing in which.

DESCRIPTION OF THE PREFERRED EMBODIMENTS

Figure 1:
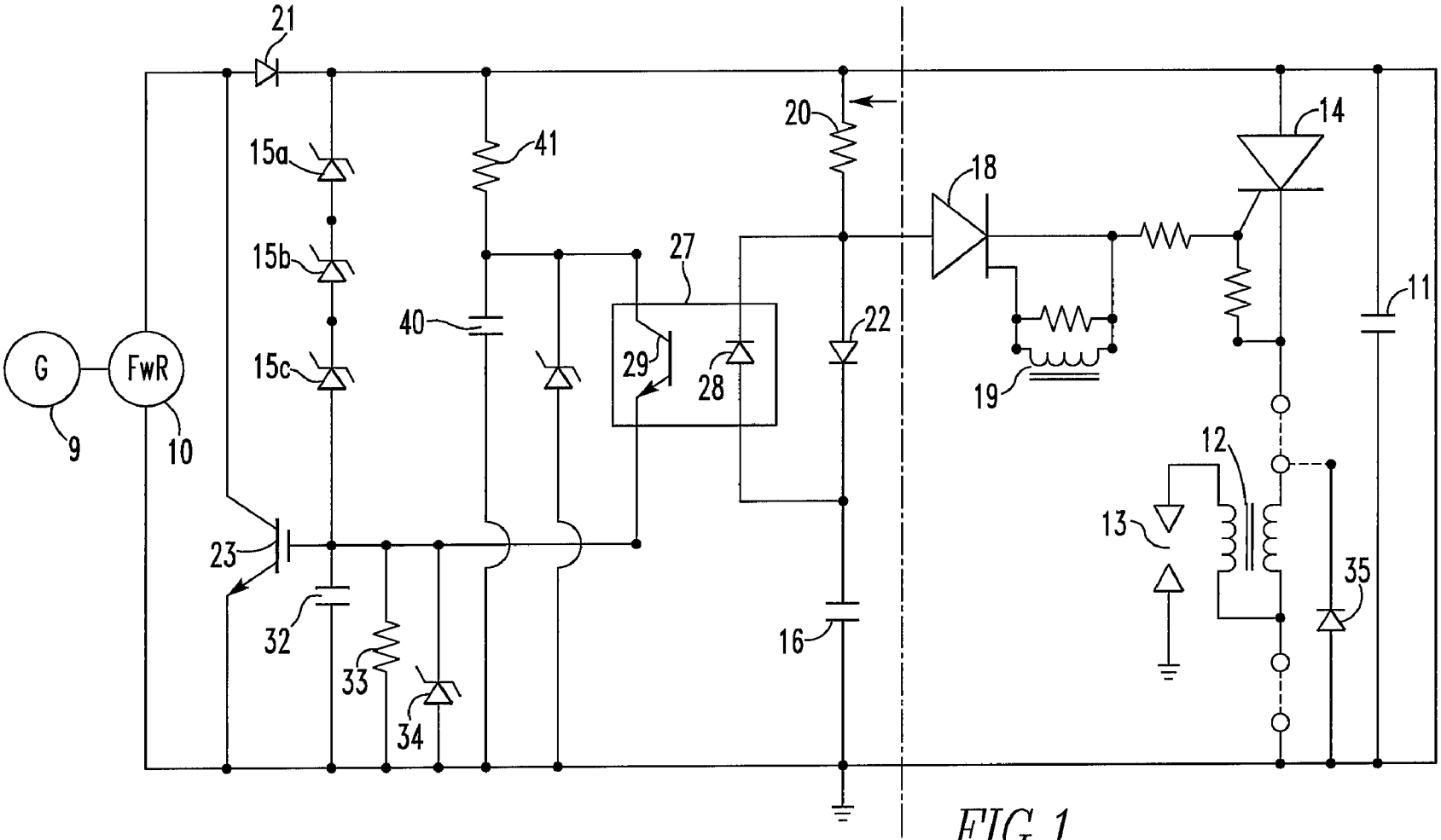
FIG. 1 is a schematic diagram of the circuit according to one embodiment of this invention having an optocoupled phototransistor in the gating circuit configured to sense the triggering current pulse to the power thyristor and turns on the shorting FET.

Referring now to the drawing, there is shown a capacitive discharge ignition system for one cylinder of an internal combustion spark ignition engine. Each component to the right of the dashed line is replicated the number of times there are cylinders to be served. For purposes of illustration of the instant invention, the circuit for one cylinder will suffice.

The storage capacitor 11 is charged by the output of the full wave rectifier 10 to store energy between each spark plug firing. The alternating current input to the full wave rectifier is taken from a generator 9 (or alternator) associated with the engine. The energy stored on the storage capacitor 11 is discharged to the primary of a step-up coil 12. The secondary of the step-up coil is connected across the spark plug 13 (or plugs) as shown. Discharge of the storage capacitor 11 to the coil 12 is gated by SCR 14. The zener diode network 15*a*, 15*b*, 15*c* and FET 23 limit the voltage across the storage capacitor 11. The low power zener network and FET biased in the linear mode for voltage regulation costs less and is more reliable than the older style power zener placed directly across the storage capacitor.

A triggering circuit for triggering the SCR 14 into conduction comprises a trigger capacitor 16 charged through resistor 20 and diode 22 and a trigger SCR 18. The basic characteristics of an SCR are well known: a positive pulse at the gate will start anode cathode current flowing and that flow will continue until two conditions are simultaneously met; namely, removal of the positive pulse at the gate and drop of the anode cathode current below the holding current level for the SCR.

A magnetic pick-up coil 19 or similar pick-up device provides a synchronized pick-up pulse to the gate of the trigger SCR 18. The trigger SCR then discharges capacitor 16 to the gate of the main SCR 14 driving it into conduction. The trigger capacitor and trigger SCR amplify the pick-up pulse. They also provide isolation between the pick-up pulse (which may not fall off rapidly) and the main SCR. The discharge of the trigger capacitor is completed before the magnetically induced trigger pulse is removed from the gate of SCR 18. This is important to the quick turn off of the main SCR 14. Turn off of the power SCR 14 has remained a problem even with the isolation provided by the resistor through which the trigger capacitor is charged, trigger capacitor and trigger SCR as described above. Even if the gate pulse is removed, SCR 14 will continue to conduct as long as there is a source of anode cathode current. The generator and full wave rectifier 10 can supply that current even after the storage capacitor is discharged.

What follows is a description of the improvement for ensuring shut-down of SCR 14 by grounding the output of the full wave rectifier, or the generator as the case may be, during just the right time period. An LED 28 of optocoupler 27 is arranged in series with the discharge of the trigger capacitor 16. The LED polarity is such that only the trigger capacitor 16 discharge current is sensed and not the capacitor charging current which flows through the diode 22. Current through the LED comprises a signal for gating field effect transistor (FET) 23. The polarities of the LED and charging diode eliminate the possibility of an undesired turn on of FET 23. FET 23 is arranged to ground the output of the full wave rectifier but not to discharge the storage capacitor. Diode 21 prevents discharge of the storage capacitor 11 when the FET 23 is conducting. With the embodiment shown in the drawing, the output of the full wave rectifier is grounded. If the output of the generator is grounded, it will be necessary to provide back-to-back FETs between the output and ground in order that both positive and negative output pulses are diverted away from the full wave rectifier and, thus, the storage capacitor. In this embodiment, the diode 21 is not required as its function would be served by the full wave rectifier itself.

The circuit for controlling the on-time of the FET 23 will now be described. The trigger capacitor 16 is charged through full wave rectifier 10 and is discharged through trigger SCR 18. In parallel with the diode 22 is the current-sensing circuit comprising the LED 28 of an optocoupler 27. During discharge of the trigger capacitor 16, current flows through the optocoupler LED 28 turning on output phototransistor 29.

Almost immediately after the phototransistor 29 begins conducting, capacitor 32 is charged from a capacitor 40 to the voltage of a zener diode 34. The higher positive voltage at the gate of the FET 23 increases the current flow from the source to the drain of the FET shorting the full wave rectifier to ground. Since the FET gate has very high input impedance, the capacitor 32 does not discharge through the gate. Also, charge on the capacitor cannot reach the breakover voltage of the FET gate because it will first discharge through the protective zener diode 34. As the storage capacitor 11 discharges, the voltage on capacitor 40 drops down below the voltage across capacitor 32 and, therefore, it can no longer supply current to capacitor 32. Were the FET to cease conducting at this time, it would do so before the storage capacitor 11 had fully discharged. Nothing would be gained by the added circuitry because the holding circuit for SCR 14 would never be cut off. The FET must remain conducting until after the capacitor 11 fully discharges. The RC time constant of the capacitor 32 and resistor 33 are selected to delay the time when the voltage on capacitor 32 drops below the threshold gate voltage of the FET. The FET is held conducting just beyond the time of complete discharge of the storage capacitor 11 and ring-out of the coil 12. The SCR 14 turns off and the storage capacitor can begin recharging for the next cycle.

The positive shut-off of the SCR 14 makes the circuit much more versatile. For example, a diode 35 can be placed in parallel with the primary to lengthen the duration of the spark. The shut-off of the SCR is less sensitive to the output voltage of the full wave rectifier. There is no need to attempt to synchronize the nodes in the generator output with the discharge of the storage capacitor. Also, the generator output may be increased without regard to the holding current rating of the SCR 14.

In a particular embodiment ignition for which the circuit according to this invention is useful, the time between spark firings is 5 milliseconds. The time between polarity reversals of the alternator or generator is between 1 and 2 milliseconds. A 1 or 2 millisecond delay before recharging of the storage capacitor is considered very undesirable. With the SCR shut-off circuit according to this invention, discharge of the storage capacitor would be expected in about 40 microseconds. The gating circuit of the FET switch is designed to hold the FET in conduction for about 200 to 300 microseconds to allow for coil ring out. Hence, recharge of the storage capacitor can begin after about 200 to 300 microseconds as opposed to 1 to 2 milliseconds. The times given in this paragraph are exemplary only. The time between firings depends on the number of cylinders being served by the ignition system and the speed of the engine. The time between polarity reversals also depends upon the speed of the engine as the alternator is driven by the engine. Preferably, the capacitor 32 and resistor 33 at the gate of the FET 23 switch to ground the output of the alternator for about 100 to 200 microseconds after the storage capacitor has discharged.

It is possible to modify the circuit shown in the drawing somewhat. For example, it may be possible to use a bipolar transistor in place of the FET. However, if this is done, it must be recognized that the capacitor 32 will discharge both through the resistor 33 and the base of the transistor. This can be considered in the design of the timing circuit with some difficulty since the voltage current relationship through the base is not linear. Moreover, if the temperature of the transistor is not held constant, the current voltage relationship for the base will not be held constant. It is also possible to substitute an optocoupled device having a photo SCR rather than a phototransistor. In this case, attention must be paid to selection of the components such that the current in the photo-SCR falls below its holding current enabling shut-off.

It is a significant advantage of this circuit over the prior art including U.S. Pat. No. 4,522,184 that the series diodes needed to sense the discharge of the storage capacitor through the power thyristor have been eliminated. These diodes carried the full 50 ampere discharge current and caused considerable power loss (~100 watts).

Having thus defined my invention with the detail and particularity required by the Patent Laws, what is desired protected by Letters Patent is set forth in the following claims.

The invention claimed is:

1. A capacitive discharge ignition system for an internal combustion engine and for use with a generator powered current source comprising a storage capacitor charged through a rectifying means, at least one thyristor for discharging the storage capacitor to transfer energy to at least one spark plug and a triggering circuit for triggering the at least one thyristor in synchronism with an internal combustion engine with which the ignition system may be associated, a triggering capacitor discharged through a circuit for triggering the thyristor discharging the storage capacitor, a circuit for sensing current flow in the thyristor in the triggering circuit and generating a control signal indicative thereof, a solid state device for switching the output of the generator to ground, and means for gating the solid state device into conduction in response to said control signal.

2. A capacitive discharge ignition system according to claim 1, wherein said circuit for sensing flow in the triggering circuit comprises an LED in parallel with a charging diode, both in series with a trigger capacitor and arranged for the LED to only conduct when the trigger capacitor is discharging.

3. A capacitive discharge ignition system according to claim 1, wherein said gating means comprises an optocoupled device connecting one side of a trigger capacitor and the gate of the solid state device.

4. A capacitive discharge ignition system according to claim 1, wherein the gating means comprises a solid state device, wherein a current sensed by said LED provides a voltage sufficient to turn the solid state device into conduction.

5. A capacitive discharge ignition system according to claim 1, wherein the solid state device comprises an FET.

6. A capacitive discharge ignition system according to claim 1, wherein the thyristor is an SCR.

7. A capacitive discharge ignition system according to claim 1, wherein the means for gating the solid state device conducts until just after the storage capacitor is discharged.

8. A capacitive discharge ignition system according to claim 1, wherein at the solid state device gate there is a holding capacitor, resistor and zener diode in parallel with the holding capacitor, such that the capacitor charges when the discharge signal is applied to the gate, the resistor discharges the capacitor when a discharge signal terminates and the zener diode limits the voltage across the small capacitor.

9. A generator-powered capacitive discharge ignition system for an internal combustion engine comprising a generator for charging a storage capacitor through a diode, at least one spark plug transformer and at least one spark plug in series with the secondary coil of the transformer, at least one SCR for discharging the storage capacitor to the primary of one spark plug transformer and a triggering circuit for gating the at least one SCR in synchronism with an internal combustion engine, with which the ignition system may be associated, a triggering capacitor discharged through a thyristor for triggering the SCR to discharge the storage capacitor, a circuit for sensing current flow in the thyristor in the triggering circuit and generating a control signal indicative thereof, a high gate impedance FET for shunting the output of the generator to ground, means for gating the FET into conduction in response to said control signal comprising an optocoupled device connecting one side of a capacitor and the gate of the FET, means for holding the control signal until just after the storage capacitor has discharged comprising an RC timing circuit at the gate of the FET, and means for biasing the FET in the linear mode of operation so that it can limit the maximum charged voltage of the storage capacitor.

10. A generator-powered capacitive discharge ignition system according to claim 9, wherein the same solid state device used to interrupt the current flow from the generator to the thyristor is also used as a linear shunt regulator to control the maximum voltage of the storage capacitor.

* * * * *

UNITED STATES PATENT AND TRADEMARK OFFICE

CERTIFICATE OF CORRECTION

PATENT NO. : 7,699,044 B2
APPLICATION NO. : 12/185851
DATED : April 20, 2010
INVENTOR(S) : Lepley It is certified that error appears in the above-identified patent and that said Letters Patent is hereby corrected as shown below:

Column 6, Line 31, "according to claim 9" should read -- according to claim 1 --

Signed and Sealed this

Seventeenth Day of August, 2010

David J. Kappos

David J. Kappos
*Director of the United States Patent and Trademark Office*